United States Patent [19]

Nava

[11] Patent Number: 4,598,430

[45] Date of Patent: Jul. 8, 1986

[54] INTEGRAL HELMET, IN PARTICULAR FOR SPORTS USE

[76] Inventor: Pier L. Nava, Via Carnovali 105, Bergamo, Italy

[21] Appl. No.: 651,250

[22] Filed: Sep. 17, 1984

[30] Foreign Application Priority Data

Oct. 28, 1983 [IT] Italy ..... 23536 A/83

[51] Int. Cl.[4] ..... A42B 3/02

[52] U.S. Cl. ..... 2/410; 2/424; 2/425

[58] Field of Search ..... 2/10, 410, 424, 425, 2/6, 421, 415

[56] References Cited

U.S. PATENT DOCUMENTS 2,105,028 1/1938 Dickhoff ..... 2/425 X
4,094,015 6/1978 Howard ..... 2/415
4,290,150 9/1981 Guerre-Berthelot ..... 2/6 X

FOREIGN PATENT DOCUMENTS 2087712 6/1982 United Kingdom ..... 2/425
2120081 11/1983 United Kingdom ..... 2/421

*Primary Examiner*—Louis K. Rimrodt
*Attorney, Agent, or Firm*—Ladas & Parry

[57] ABSTRACT

The lower aperture of helmet body A is provided with an annular element B consisting of at least two segments: one fixed segment $B_3$ secured to said body and the other or other segments $B_1$–$B_2$ retained to the former by hinges 26. Said segments are bound to each other by a latch K on the adjacent ends of the segments, said segments being provided, at their top edges, with restrained joints 14, and adjacent to their lower edges, with fins 32 apt to retain a padding cooperating with the wearer's nape and jaw.

16 Claims, 7 Drawing Figures

INTEGRAL HELMET, IN PARTICULAR FOR SPORTS USE

DESCRIPTION

Figure 1:
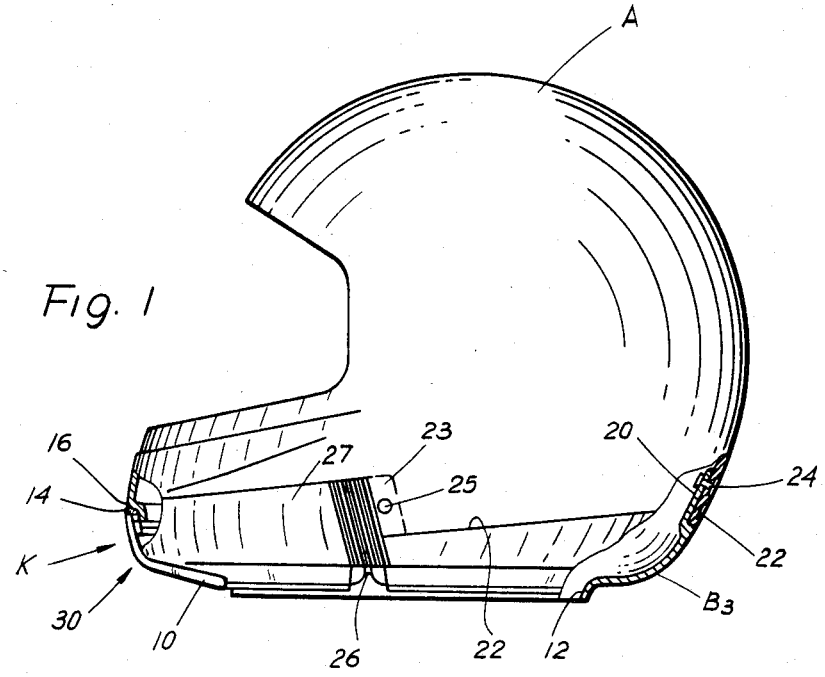

This invention relates to an integral helmet, particularly suited for sports use.

The present known types of helmets used by motorcyclists and sportsmen, especially integral helmets, whilst suitable to meet general needs, require means to retain them safely and securely on the wearer's head. For this purpose the lower aperture of the helmet is provided with movable segments having hinged latches; when opened, said latches permit insertion of the helmet on the user's head, and when closed engage the wearer's nape on the rear and his chin on the front.

Although the above solution satisfies, on the one hand, the requirements mentioned, on the other hand it does not fully ensure resistance to the stresses which occur during use, particularly the dynamic stresses which occur along the vertical axis and the composite stresses which involve several axes of the helmet.

The purpose of this invention is to provide an integral helmet in which the lower part of the body is both statically and dynamically resistant while it adapts itself satisfactorily to the user's nape and neck to permit simple, expeditious and constant ready use of the helmet.

A further object of the invention is to provide a helmet which maintains its external appearance and does not present vertically engageable movable parts, that may cause drawbackes or impediments in use. The integral helmet according to this invention is characterized by an annular body of elastically yielding material, consisting of at least two segments; the first segment is secured to the aperture in the body of the helmet and the second segment is retained to the former by hinges and is securable to this movably by a latch; its top edge is provided with locking devices apt to engage it with the aperture of the helmet body, to ensure resistant continuity between said helmet body and the annular body; the lower edge of said segments is at least in part folded inward to engage at least part of the wearer's nape and jaw through a suitable padding.

According to this invention, the rear segment of the annular body is conceived as a part separate from the helmet body and its top edge is provided with at least one fin which may be engaged securely to the internal wall of the helmet body to form an integral part of the latter.

In one advantageous embodiment of the integral helmet, the front segment of the annular body consists of two elementary segments, the opposite ends of which are retained to the rear segment, which is secured to the body by hinges and the adjacent ones engage and cooperate with each other by restrained joints and are locked by the latch. In order to avoid unwanted catches or projecting parts on the helmet, the latch for the segments of the annular body is provided with an angular slider retained in rectilinear guideways in the folded edge of one of the walls of said segments to be secured to each other, whilst one of the ends of the slider is provided with engaging elements, the complementary parts of which are provided in said segments which are thus locked by the slider.

The invention will now be explained in the following description, in conjunction with the annexed drawing which illustrates, by way of example, some of the preferred forms of embodiment of the helmet according to the invention.

Specifically:

FIG. 1 is a side elevation view of the integral helmet, with parts shown in cross section.

Figure 2:
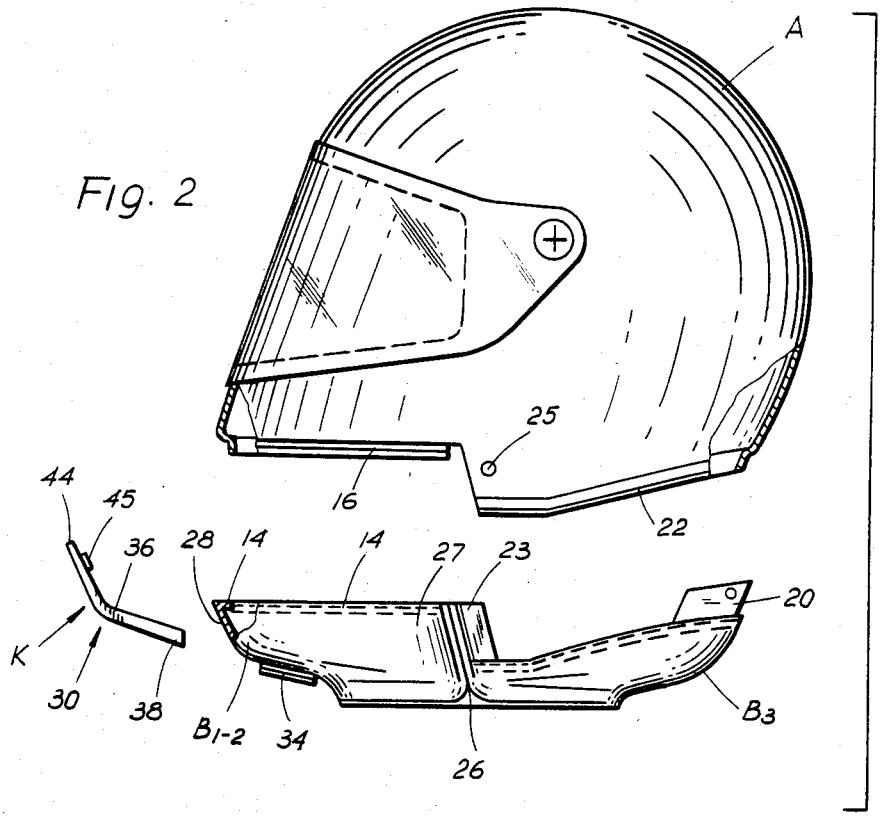
Figure 3:
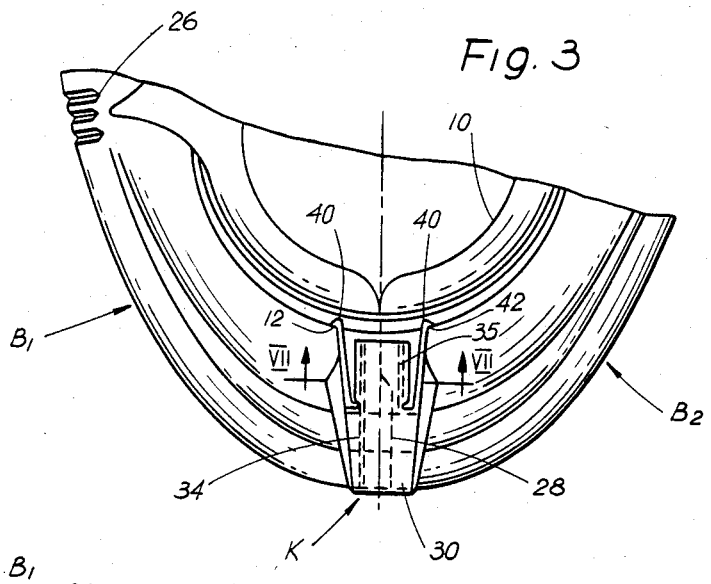
Figure 4:
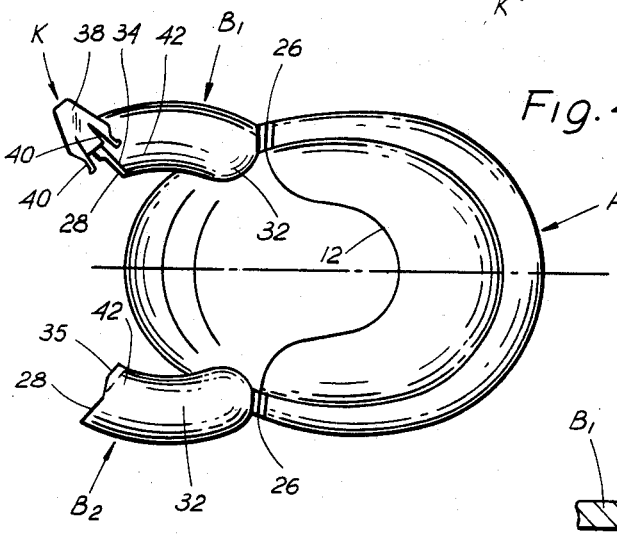

FIG. 2 similar to FIG. 1, shows the helmet with some of its parts in exploded view FIGS. 3 and 4, are bottom to top views of the helmet shown in FIG. 1, with the segments of the annular body shown in their open and closed positions.

Figure 5:
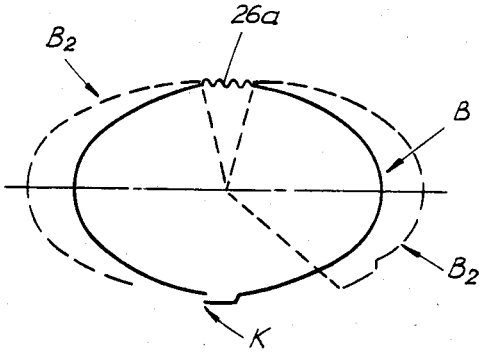
Figure 6:
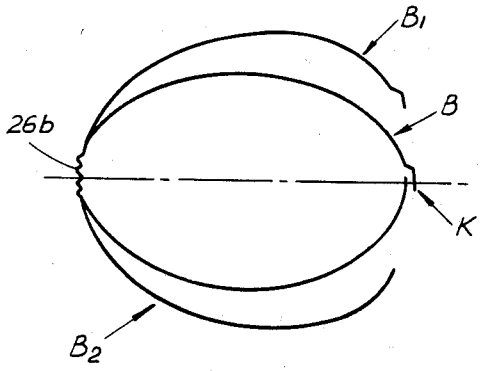

FIGS. 5 and 6, similar to FIGS. 3 and 4, are schematic views of variants of the collar applicable to the helmet.

Figure 7:
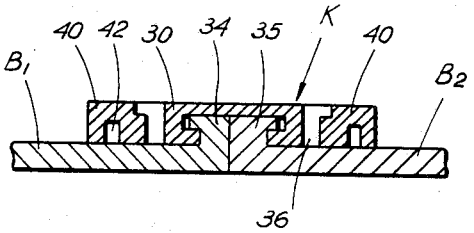

FIG. 7 is a cross sectional detail of the latch.

With reference to FIGS. 1 thru 4 of the drawings, body A of the helmet is provided, on its bottom part with an annular body or collar B, consisting of 2 segments, a rear segment $B_1$ and a front segment $B_2$ which, in their open position (shown in FIG. 4), determine the aperture required to enable insertion of the helmet on the wearer's head.

In the case illustrated, collar B consists of three segments: front segments $B_1$ and $B_2$ and rear segment $B_3$ made of suitable material which may differ if necessary, from the material of body A.

Front segments $B_1$ and $B_2$ and rear segment $B_3$ are shaped at an angle and their bottom edges 10 and 12 are concave to delimit an aperture, when closed (FIG. 3); corresponding substantially to the wearer's neck and which cooperate with the wearer's chin and nape by means of suitable paddings, not shown.

Top edges 14 of front segments $B_1$ and $B_2$ are suitably shaped to form a restrained joint with the bottom edge 16 of body A when said segments are closed. One of the elements of said pairs of edges may be provided with grooves (or ledges) and the other element may have ledges (or grooves) so that when the elements are closed, they engage with each other, to form, with body A a monolithic structure resistant to vertical stresses in particular. Rear segment $B_3$ terminates in its mid part, with a fin 20 suitably recessed to form a shoulder cooperating with the bottom edge 22 of helmet body A. Said fin engages the internal rear wall of the helmet body and is secured to said body by rivets or similar means 24.

To ensure retention of rear segment $B_3$ to helmet body A, the segment is provided, at its extremities with preforated fins 23, which are also recessed to form shoulders for the corresponding edges of said body. The latter are also perforated to receive the rivets or similar means 25.

It is not to be excluded that rear segment $B_3$ may be provided directly in helmet body A, as will be described infra.

The front semi segments $B_1$ and $B_2$ substantially e equal to each other, are retained by hinges 26 to the free ends of rear segment $B_3$ and are locked and secured to helmet body A by a latch K, to be described infra. Hinges 26 may be formed by utilizing the flexibility of the elements forming collar B by providing at the folding zones parallel undulationns, on one side at the end of rear segment $B_3$ and on the other side to vertical walls 27 of semi-segments $B_1$–$B_2$ and $B_3$.

The adjacent ends of end 28 of semi segments $B_1$ and $B_2$ are latch shaped to enable closing of collar B, ensured by the action of latch K.

With reference to FIGS. 1 thru 4 latch K for semi segments $B_1$ and $B_2$ consists of an angular body 30 which constitutes the slider for said latch, shaped so as to cooperate with the angular walls of said elementary semi-segments.

Specifically, lower walls 32 (substantially horizontal) of semi-segments $B_1$ and $B_2$ are provided, in the proximity of their adjacent opposite ends, with a pair of prismatic ledges 34–35, which constitute guides for the related opposite grooves 36 provided along the longitudinal edges of lower fin 38 of slider 30 which is the slider of latch K.

Lower fin 38 of said slider 30 terminates at its free end, with a pair of elastic teeth 40 which engage with relevant pins 42 located at a suitable position on horizontal walls 32 of semi segments $B_1$ and $B_2$ thus to secure said slider in the closed position (FIG. 3).

The two prismatic ledges 34 and 35 extend in parallel along the lower edges of semi-segments $B_1$ and $B_2$, one of them being shorter than the other.

When latch K is closed (FIG. 3), elastic teeth 40 engage with pins 42 to retain semi segments $B_1$ and $B_2$ closed on each other.

On the other hand, latch 30 is opened by acting simultaneously on the ends of elastic teeth 40 to bring these close to each other and disengage them from pin 42.

In this case, slider 30 can be caused to run along prismatic guides 34–35 provided in horizontal walls 32 of semi segments $B_1$–$B_2$ and disengage only from shorter guide 35 so that said semi-segments $B_1$ and $B_2$ will be free to open.

Slider 30 will remain lock and to semi segment $B_1$ by prismatic guide 34 which is longer than guide 35 in semi segment $B_2$.

To ensure closing of semi segments $B_1$ and $B_2$, slider 30 is provided, on its rear part, with an appendix 44 which adapts to vertical edges 28 of said semi segments and is provided, on its inner face, with a couple of elastic ledges 45 engaging forcibly with the associated openings in the proximity of said edges 28.

With reference to FIG. 5, this shows a schematic view from bottom to top of a variant of the helmet.

In this variant, the bottom aperture of helmet body A is delimited by a collar $B_1$ formed by two segments $B_1$ and $B_2$ having substantially the same characteristics of semi segments $B_1$ and $B_2$ previously considered in FIGS. 1 thru 4.

The two segments $B_1$ and $B_2$ are retained at one of their ends by a hinge 26*a* the pin of which (or its mid part in the case of a flexible hinge) is secured to helmet body A. Conversely, the other ends of said segments $B_1$ and $B_2$ are restrained and may be locked to each other by a latch (K) the actuation of which permits opening of the two segments $B_1$ and $B_2$ to enable insertion of the helmet.

Obviously the hinging of the two segments $B_1$ and $B_2$ to the aperture of helmet body A can be provided (instead of the arrangement shown in FIG. 5), also on the mid longitudinal axis of the helmet, that is, at approximately 90 degrees with respect to pin 26*a*.

According to the further variant of FIG. 6, collar B is provided with two pairs of semi segments $B_1$–$B_2$ and $B_3$–$B_4$ the elements of each pair being secured to each other on the one side by hinges 26*b* and on the other by latches $K_1$ and $K_2$. Also in this variant, the pins of hinges 26*b* are retained securely on helmet body A.

Further modifications and variants may be introduced, especially as regards latch K of the collar and hinges 26, but without departing from the domain and spirit of the invention.

I claim:

1. An integral helmet especially suited for sports use, provided with an annular unlockable body made of elastically yielding material, said annular body comprising of at least two segments, the first segment ($B_3$) being secured to the aperture of the body of the helmet (A), the second segment ($B_1$–$B_2$) being retained movably as to said first segment by hinges (26), the top edge of said segments ($B_1$, $B_2$) being provided with locking elements (14) apt to engage it with the aperture of the helmet to ensure resistant continuity between the helmet body and said annular body, the adjacent ends of said tiltable segment $B_1$ and $B_2$ being externally locked to each other by means of a latch (K).

2. An integral helmet according to claim 1 wherein the lower edges (10, 12) of said segments ($B_1B_2$) are at least partly folded over inwardly to cooperate, preferably by means of a padding, with the wearer's jaw and nape.

3. An integral helmet according to claim 1 wherein the top edge (14) of the second segment ($B_1$–$B_2$) is provided with at least one ledge (or groove) apt to engage with at corresponding groove (or ledge) on the edge of the aperture of the helmet body aperture to provide thereby a suitable firm connection between said body and jaw segment in the wearing position.

4. An integral helmet according to claim 3 wherein latch (K) is on an angle zone of annular body (B), that is provided with an angular slider (30) one of the fins of which cooperates slidably with guideways (34–35) on the adjacent ends of said annular body and with latching means (34–35–36) for tiltable segment ($B_1$–$B_2$) while the other fin (40) of said slider (30) is provided with connecting and locking means (44–45) for said tiltable segment.

5. An integral helmet according to claim 1 wherein the transversal adjacent edges (28) of the two tiltable elements $B_1$ and $B_2$ are provided with grooves or ledges which may be locked to each other.

6. An integral helmet according to claim 1 wherein the first segment ($B_3$) is provided, along a part of its top edge, with at least one fin (20), securable to helmet body (A).

7. An integral helmet according to claim 1 wherein the first segment ($B_3$), secured to helmet body (A), has an angular width comprised between 10° and 20°.

8. An integral helmet according to claim 1 wherein hinge (26) between fixed segment ($B_3$) and tiltable segment ($B_1$–$B_2$) is derived at least in part from the elastically yielding material forming partly annular body (B).

9. An integral helmet according to claim 8 wherein hinge (26) between fixed segment $B_3$ and tiltable segment ($B_1$–$B_2$) is provided with one or more substantially parallel impressions extending transversally with respect to the generatrix of said annular body.

10. An integral helmet according to claim 1 wherein the angular width of the first segment ($B_3$) has a reduced width so as to retain the joint zone of hinge (26) for the two tiltable elements ($B_1$ and $B_2$) which may be secured by latch (K).

11. An integral helmet according to claim 1 wherein the axis of hinge/hinges (26) is located on the longitudinal and/or transversal plane of the helmet.

12. An integral helmet according to claim 1, wherein the axis of hinge (26*b*) is located on the rear of the mid-part of the aperture of the helmet body.

13. An integral helmet according to claim 1 wherein latch (K) is on an angle zone of annular body (B), that is provided with an angular slider (30) one of the fins of which cooperates slidably with guideways (34–35) on the adjacent ends of said annular body and with latching means (34–35–36) for tiltable segment ($B_1$–$B_2$) while the other fin (40) of said slider (30) is provided with connecting and locking means (44–45) for said tiltable segment.

14. An integral helmet according to claim 13 wherein the slider (30) is provided, along its longitudinal edges, with opposite slots (36) which engage slidably a pair of prismatic projecting parts (34–35), the elements of said pairs being provided on the adjacent edges of the ends of the segments forming annular body (B), one of said segments being longer than the other, to retain said slider when segments ($B_1$–$B_2$) are disengaged one from the other.

15. An integral helmet according to claim 14 wherein lower fin (38) of slider (30) is provided at its end with a pair of teeth (40) apt to engage pins (42), secured to the segments of annular body (B).

16. An integral helmet according to claim 13 wherein lower fin (38) of slider (30) is provided at its end with a pair of teeth (40) apt to engage pins (42), secured to the segments of annular body (B).

* * * * *